US007601030B2

(12) United States Patent
Patel

(10) Patent No.: US 7,601,030 B2
(45) Date of Patent: Oct. 13, 2009

(54) METHOD AND APPARATUS FOR DIRECTLY MOUNTING FUSES TO TRANSFORMER TERMINALS

(75) Inventor: Dhiru S. Patel, Guelph (CA)

(73) Assignee: Hammond Power Solutions, Inc., Ontario (CA)

( * ) Notice: Subject to any disclaimer, the term of this patent is extended or adjusted under 35 U.S.C. 154(b) by 0 days.

(21) Appl. No.: 11/707,334

(22) Filed: Feb. 16, 2007

(65) Prior Publication Data

US 2008/0197961 A1 Aug. 21, 2008

(51) Int. Cl.
*H01R 13/68* (2006.01)

(52) U.S. Cl. ..... 439/620.3

(58) Field of Classification Search ..... 439/621; 363/171, 34, 36, 84, 125
See application file for complete search history.

(56) References Cited

U.S. PATENT DOCUMENTS 3,333,328 A * 8/1967 Rushing ..... 29/596
3,351,878 A * 11/1967 Hajicek ..... 336/155
3,418,615 A 12/1968 Canney
3,469,056 A * 9/1969 O'Connor ..... 219/69.2
3,476,563 A 11/1969 Roy
3,516,040 A 6/1970 Ripley et al.
3,916,259 A 10/1975 Russell et al.
4,260,215 A 4/1981 Gross et al.
4,575,670 A * 3/1986 Hignutt ..... 320/116
4,775,766 A * 10/1988 Kooy et al. ..... 200/11 TC
4,810,991 A 3/1989 Olesak et al.
5,116,246 A 5/1992 Perry et al.
5,879,203 A 3/1999 Egle et al.
5,892,667 A * 4/1999 Glasband et al. ..... 363/36
6,278,266 B1 * 8/2001 Glasband ..... 323/355
6,806,662 B1 * 10/2004 York ..... 318/400.03

* cited by examiner

*Primary Examiner*—Jean F Duverne
(74) *Attorney, Agent, or Firm*—George E. Haas; Quarles & Brady

(57) ABSTRACT

A transformer which includes a primary winding having a plurality of primary winding taps, and a secondary winding having a plurality of secondary winding taps. A core is included on which the primary winding and the secondary winding are mounted. The primary winding and the secondary winding are electromagnetically coupled through the core. At least one terminal block is provided where each terminal block is connected to the primary winding taps or the plurality of secondary winding taps. Each terminal block includes at least a first row of terminals and a second row of terminals, and at least some of the first row of terminals are each connected to a corresponding one of the winding taps.

30 Claims, 8 Drawing Sheets

METHOD AND APPARATUS FOR DIRECTLY MOUNTING FUSES TO TRANSFORMER TERMINALS

FIELD OF THE INVENTION

The present invention relates to transformers, and, more particularly, to a method and apparatus for directly mounting fuses to transformer terminals.

BACKGROUND OF THE INVENTION

Control transformers are generally isolation transformers that provide a high degree of secondary voltage stability during a brief period of overload current (also known as "inrush current"), as may be the case when relay contacts close to energize an inductive load such as a coil of an electromechanical relay, or a motor, among many other situations. In an industrial control circuit application, a control transformer is a relatively small product where overall dimensions are very critical as they may be part of a programmable logic controller, or motor control center for example, which have limited space for the control transformer. A control transformer has a primary winding connected to a power source and one or more secondary windings connected to a load. The end of the windings, or winding taps, are terminated into terminals or terminal blocks where a user makes their connections.

To protect the transformer from any fault arising on the load side, various options are available. For example, one option is that secondary fuse(s) are used between secondary transformer terminals and the load circuit. In the event of fault, one or more secondary fuse blows and isolates the load from control transformer; however, in this case the transformer remains energized. In another option, fuses are used between the power source and the primary terminals of the control transformer. In the event of a fault in the load circuit or in the transformer, the primary fuse(s) blow; thus, the control transformer is disconnected from the source of power. In yet another option, fuses are used both on the primary and secondary side of the transformer. These fuses can be mounted on the control transformer or at another location of the electrical system which is associated with the control transformer, such as a circuit board.

Additionally, and in a single secondary winding arrangement, two wires come to secondary terminals from the load. Fuses can be installed on one wire or both, but connecting fuses on both wire gives complete load isolation from the power source through the control transformer. If there are more than one isolated secondary winding or multi-tapped windings, and if a user desires complete load isolation, then at least one fuse is required for each output to disrupt current to each load during a fault condition.

FIGS. 1A and 1B illustrate prior art examples where one or more fuses can be electrically connected to either of primary or secondary taps, and where the fuse holders are mounted on the transformer core or terminal board. External connection is made between the transformer winding and fuse holders. For example, and as can be seen in the prior art arrangements shown in FIGS. 1A and 1B, transformers 20 and 22 include a mounting plate 24, fuse holder 26, fuse clips 28, interconnecting wires 30 and their corresponding connectors 32, and fasteners 34. In the case of transformer 20, plate 24 and fuse holder 26 are mounted to core 36; whereas in the case of transformer 22, plate 24 and fuse holder 26 are mounted to terminal boards 38, which have at least some terminals connected to the primary winding taps or the secondary winding taps. The fuses are not shown in FIGS. 1A and 1B, but are held by fuse holders 26, and can typically be a glass cartridge type fuse, plug type fuse, or other types. However, there are several disadvantages to such an approach.

Firstly, the many different components add material and labor manufacturing costs to the transformer. Additionally, the multiple electrical connections, such as between connectors 32 and terminal boards 38, connectors 32 and wires 30, and connectors 32 and clips 28, reduce the reliability of the system by introducing many potential single point failure mechanisms where a loose, corroded, or otherwise contaminated or flawed connection can cause a malfunction in the electrical system in which transformers 20 and 22 are used.

Fusing arrangements are known in which a single fuse is mounted directly to the transformer terminal boards via fuse clips; however, such arrangements are limited, because of the size of the fuse relative to the spacing of the terminals on the transformer terminal board, to a single fuse on the primary side and/or the secondary side, which does not allow for complete isolation of either the power source or load.

What is needed in the art is a method and apparatus for directly mounting fuses to transformer terminals, and which can accommodate one or more fuses on either the primary or secondary side of the transformer.

SUMMARY OF THE INVENTION

The invention comprises, in one form thereof, a transformer which includes a primary winding including a plurality of primary winding taps, and a secondary winding including a plurality of secondary winding taps. A core is included on which the primary winding and the secondary winding are mounted. The primary winding and the secondary winding are electromagnetically coupled through the core. At least one terminal block is provided where each terminal block is connected to the primary winding taps or the plurality of secondary winding taps. Each terminal block includes at least a first row of terminals and a second row of terminals, and at least some of the first row of terminals are each connected to a corresponding one of the winding taps.

The invention comprises, in yet another form thereof, an electrical system which includes a controller having at least one electrical load component, and a transformer connected to the electrical load component. The transformer includes a primary winding including a plurality of primary winding taps, and a secondary winding including a plurality of secondary winding taps. A core is included on which the primary winding and the secondary winding are mounted. The primary winding and the secondary winding are electromagnetically coupled through the core. At least one terminal block is provided where each terminal block is connected to the primary winding taps or the plurality of secondary winding taps. Each terminal block includes at least a first row of terminals and a second row of terminals, and at least some of the first row of terminals are each connected to a corresponding one of the winding taps.

The invention comprises, in yet another form thereof, a transformer which includes a primary winding including a plurality of primary winding taps, and a secondary winding including a plurality of secondary winding taps. A core is included on which the primary winding and the secondary winding are mounted. The primary winding and the secondary winding are electromagnetically coupled through the core. A first terminal block is connected to the plurality of primary winding taps. The first terminal block includes a first row of terminals and a second row of terminals horizontally offset and/or vertically offset from the first row of terminals.

At least some of the first row of terminals are each connected to a corresponding one of the primary winding taps. A second terminal block is connected to the plurality of secondary winding taps. The second terminal block includes a third row of terminals and a fourth row of terminals horizontally offset and/or vertically offset from the third row of terminals. At least some of the third row of terminals are each connected to a corresponding one of the plurality of secondary winding taps.

The invention comprises, in yet another form thereof, a method of connecting a fuse to a transformer, including the steps of: providing a terminal block connected to a plurality of primary winding taps of the transformer or a plurality of secondary winding taps of the transformer, the terminal block includes a first row of terminals and a second row of terminals, at least some of the first row of terminals are each connected to a corresponding one of the winding taps, and the second row of terminals are horizontally offset and/or vertically offset from the first row of terminals; connecting a first fuse end of the fuse to the first row of terminals; and attaching a second fuse end of the fuse to the second row of terminals.

An advantage of the present invention is that it can provide one or more fuses, on either the primary or secondary side of the transformer, which are directly mounted to the transformer terminals.

Other advantages of the present invention are that it provides lower material and labor manufacturing costs for fusing arrangements mounted to a transformer.

Yet other advantages of the present invention are that it reduces component part count, and thereby increases reliability, of a transformer with fuses, or an electrical system using the same.

Yet other advantages of the present invention are that it provides a fuse arrangement which accomodates total isolation for the load or the source.

Yet another advantage of the present invention is that it provides a fuse arrangement on a transformer which uses less space.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE PREFERRED EMBODIMENT

Figure 1A:
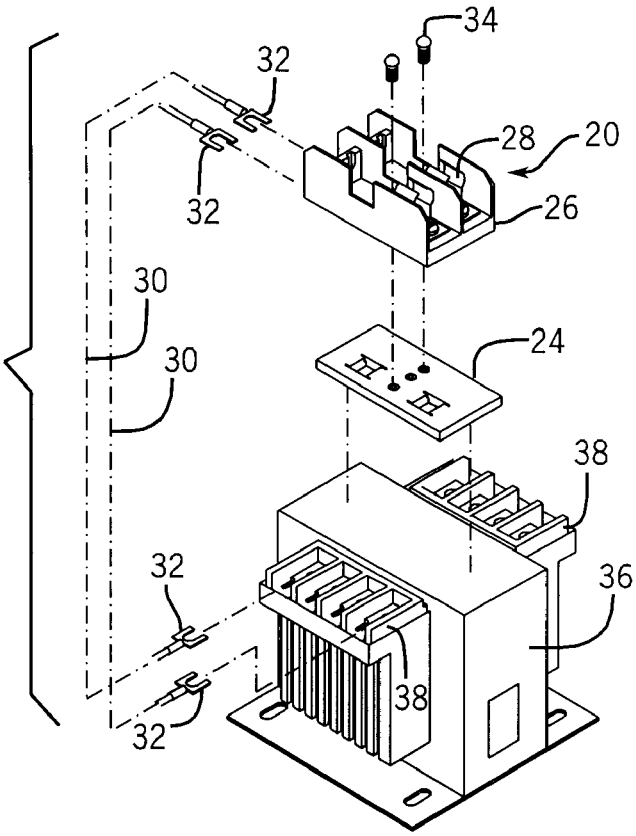
FIG. 1A PRIOR ART
FIG. 1A is an exploded perspective view of a prior art transformer with a fuse holder arrangement.
Figure 1B:
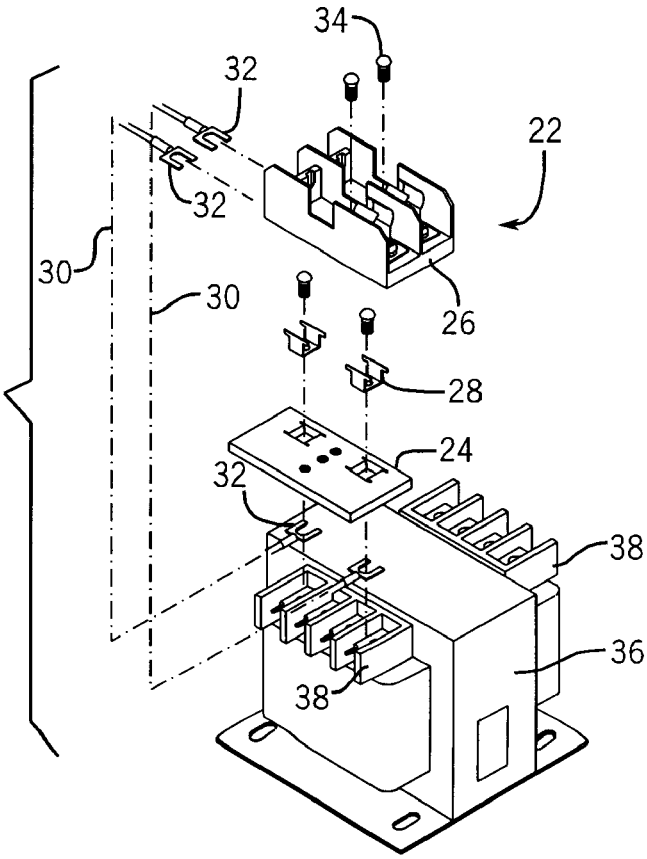
FIG. 1B PRIOR ART
FIG. 1B is an exploded perspective view of another prior art transformer with a fuse holder arrangement.
Figure 2:
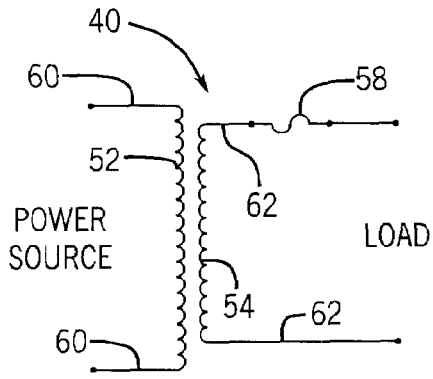
FIGS. 2-7 are diagrams of various embodiments of fusing arrangements for a transformer according to the present invention.
Figure 3:
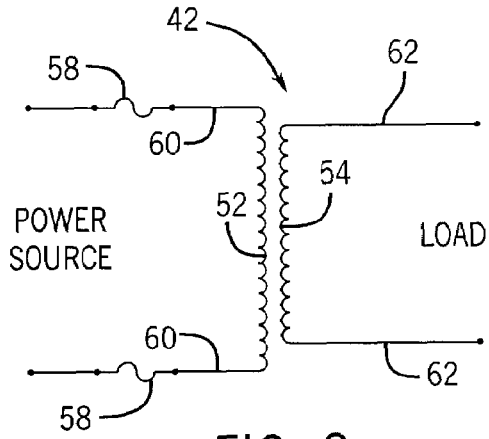
Figure 4:
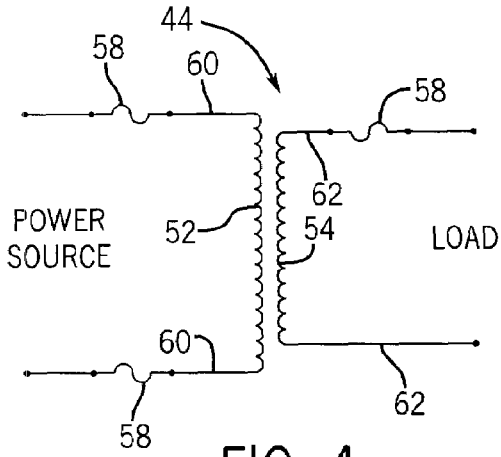
Figure 5:
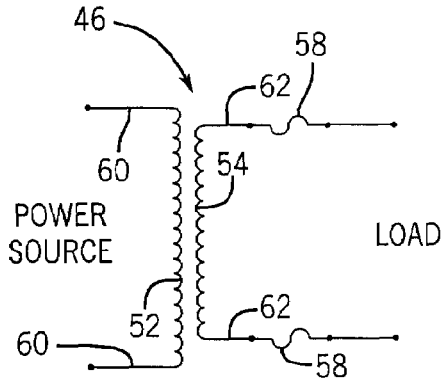
Figure 6:
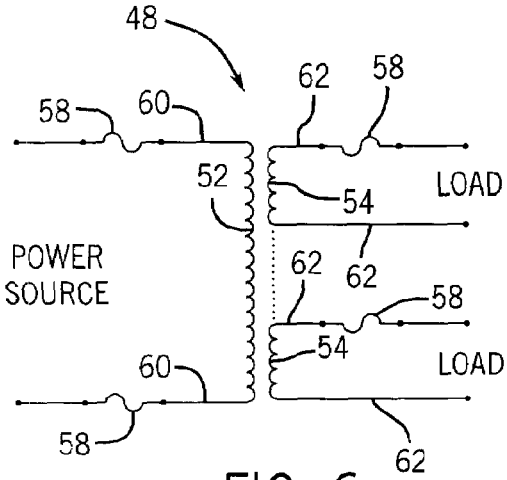
Figure 7:
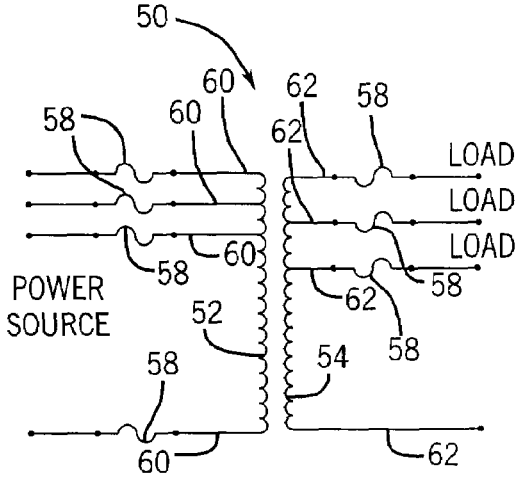
Figure 8:
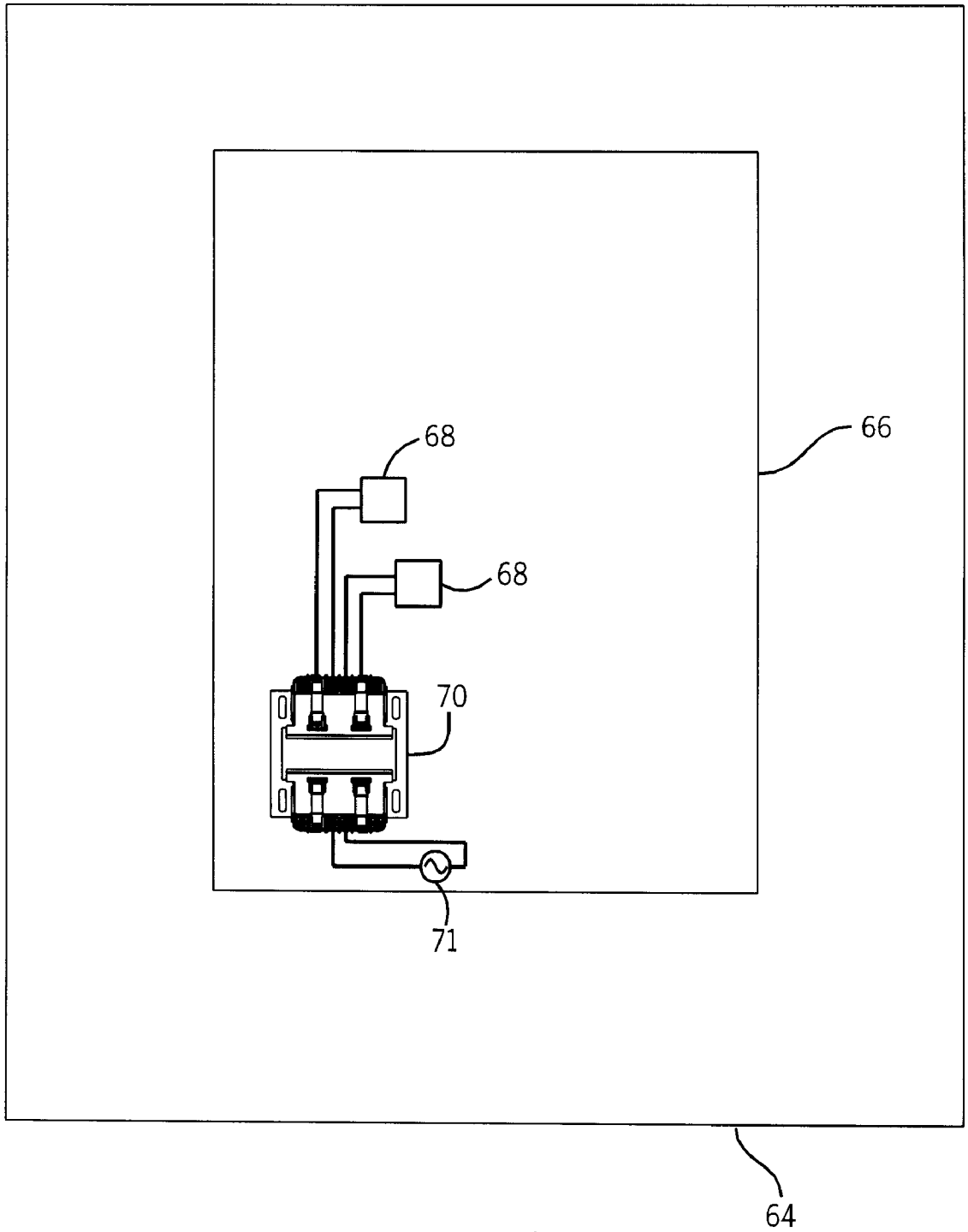
FIG. 8 is a schematic view of an embodiment of an electrical system including a transformer according to the present invention.

Referring now to FIGS. 2-7, there is shown an exemplary variety of transformer fusing arrangements 40, 42, 44, 46, 48, 50, which can be accommodated by the present invention. In general, a primary winding 52 is electromagnetically coupled to a secondary winding 54 via a core 56 (see FIGS. 9 and 10 for example). The internal construction of the windings 52, 54 and core 56 of a transformer can be achieved by a variety of means which are well known, see for example Leander W. Matsch, *Electromagnetic and Electromechanical Machines,* 2nd edition, 1977, IEP, New York, and/or www.hammond-powersolutions.com, incorporated herein by reference, although the present invention is not limited by the constructions described by these references, and can also include other primary winding, secondary winding and core configurations as are known, and other transformer types. For example, some or all of the claimed structure of the present invention can be used in a stepup or stepdown transformer, an isolation transformer and/or an auto transformer. Fuses 58 are connected to primary taps 60 and/or secondary taps 62 as desired to provide fault protection. For the purposes of this disclosure, a tap is any lead that is a start connection, a finish connection, or an intermediate connection to the winding. The present invention is not limited to the exemplifications of FIGS. 2-7, but can also include multiples and combinations thereof, or other arrangements. For example, the present invention can include a fusing arrangement similar to FIG. 6, but which includes three isolated load circuits instead of two. FIG. 7 is circuit example which includes a three-phase power source, where each phase can energize a separate load, which could be modified to include a fuse connected to the common secondary winding tap, as is shown in FIG. 5. Further, a single physical transformer can have a sufficient combination of primary winding taps 60, secondary winding taps 62, and/or jumper configurations which will allow the same transformer to be configured in all, some, or combinations of the configurations shown in FIGS. 2-7.

Referring now to FIGS. 8-11, there is shown an electrical system 64 which includes a controller 66 which has at least one electrical load component 68. For example, controller 66 can be programmable logic controller, a motor control center, a control panel or other types of control systems. Electrical load components 68 can be relays, motors, contactors, and other electrical devices, for example. A transformer 70 according to the present invention is connected to electrical load component(s) 68, and to a source of electrical power 71. Electrical system 64, controller 66 and electrical load component 68 are shown schematically in FIG. 8 as they are generally known.

Transformer 70 has a primary winding 52 including a plurality of primary winding taps 60. A secondary winding 54 includes a plurality of secondary winding taps 62. A core 56 is connected to primary winding 52 and secondary winding 54, and windings 52 and 54 are electromagnetically coupled through core 56.

A first terminal block 72 is connected to primary winding taps 60, and includes a first row 74 of terminals 76 and a second row 78 of terminals 80. Second row 78 of terminals 80 are horizontally offset and/or vertically offset from first row 74 of terminals 76. At least some of terminals 76 are each connected to a corresponding primary winding tap 60.

A second terminal block 82 is connected to secondary winding taps 62, and includes a third row 84 of terminals 86 and a fourth row 88 of terminals 90. Fourth row 88 of terminals 90 are horizontally offset and/or vertically offset from third row 84 of terminals 90. At least some of terminals 86 are each connected to a corresponding secondary winding tap 62.

Transformer 70 includes at least one fuse 58, where each fuse 58 has a first fuse end 92 and a second fuse end 94. For example, first fuse end 92 is connected to a terminal 76 of first row 74, and second fuse end 94 is connected to a terminal 80 of second row 78. Fuses 58 are connected to the terminals 86, 90 of second terminal block 82 in a similar manner. To facilitate these connections, terminal blocks 72, 82 include fuse clips 96, fuse clip braces 98, 100, fasteners 102 and terminal lugs 104, 106.

Row 74 can be approximately parallel to row 78 as shown, or in other configurations such as skewed or at an angle between 0° and 360°. Similarly, rows 84 and 88 can be parallel as shown, or in other configurations such as skewed or at an angle between 0° and 360°. Fuses 58 can be mounted approximately perpendicular to these rows 74, 78, 84 and 88, or otherwise at any angle other than 90°. Transformer 70 can include a finger guard (not shown, but can be similar to that shown in FIG. 15) which at least partially covers a corresponding terminal block. Transformer 70 can also include mounting plate 108 and other elements such as housings, etc. Alternatively, terminals 80 of second row 78 can be connected to primary winding taps 60, and first row 74 of terminals 76 can be connected to the other side of the primary fuses. Similarly, terminals 90 of fourth row 88 can be connected to secondary winding taps 62, and third row 84 of terminals 86 can be connected to the other side of the secondary fuses.

Figure 9:
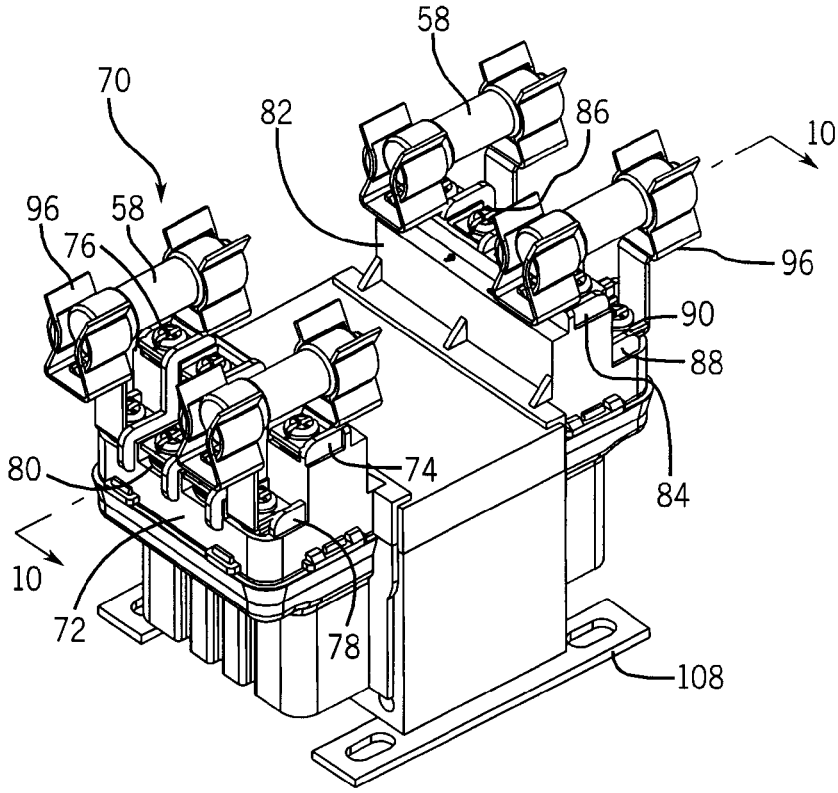
FIG. 9 is a perspective view of an embodiment of a transformer according to the present invention.
Figure 10:
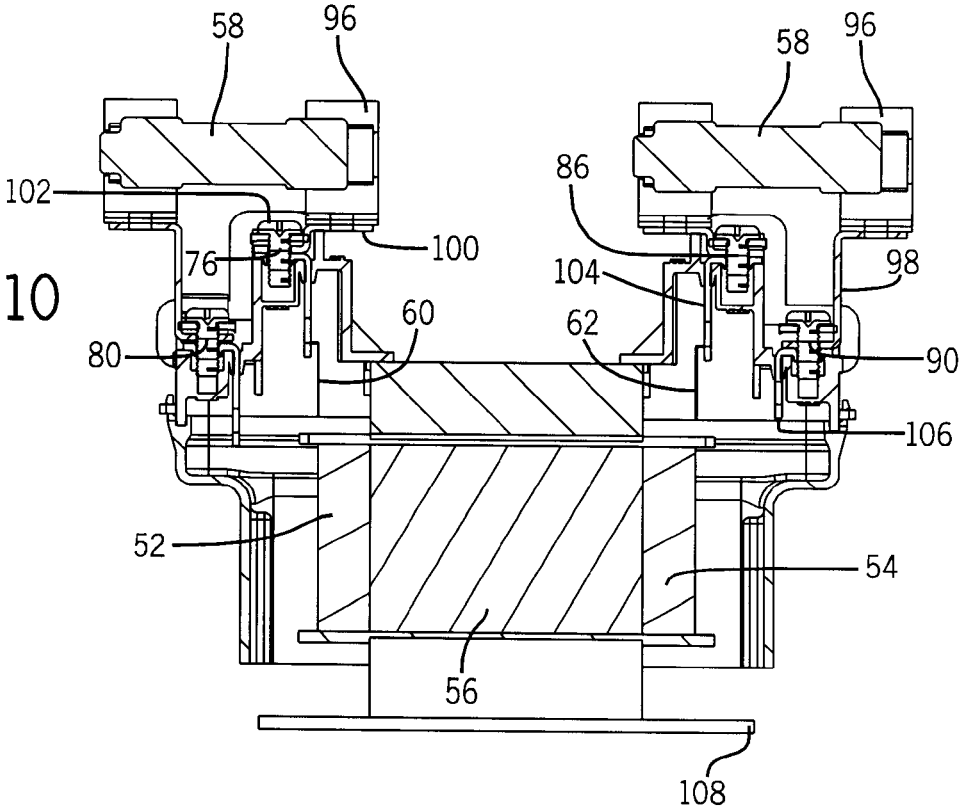
FIG. 10 is a cross-sectional view taken along section line 10-10 in FIG. 9.

In use, and for the embodiment of FIG. 9 for example, the inside terminals 80 of second row 78 are conductively connected to their adjacent outside terminals 80 of second row 78. The source of electrical power is then electrically connected to these inside terminals. Similarly, on second terminal block 82, the inside terminals 90 of fourth row 88 are conductively connected to their adjacent outside terminals 90 of fourth row 88. Load 68, or other loads, can then be electrically connected to these inside terminals.

In an another embodiment (FIGS. 12-15), transformer 110 includes a first terminal block 112 connected to primary winding taps 60, and includes a first row 114 of terminals 116 and a second row 118 of terminals 120. Second row 118 of terminals 120 are horizontally offset from first row 114 of terminals 116. At least some of terminals 116 are each connected to a corresponding primary winding tap 60. A second terminal block 122 is connected to secondary winding taps 62, and includes a third row 124 of terminals 126 and a fourth row 128 of terminals 130. Fourth row 128 of terminals 130 are horizontally offset from third row 124 of terminals 130. At least some of terminals 126 are each connected to a corresponding secondary winding tap 62. As with transformer 70, transformer 110 can include a finger guard cover 132 to protect from inadvertent contact with the terminals. Alternatively, terminals 120 of second row 118 can be connected to primary winding taps 60, and first row 114 of terminals 116 can be connected to the other side of the primary fuses. Similarly, terminals 130 of fourth row 128 can be connected to secondary winding taps 62, and third row 124 of terminals 126 can be connected to the other side of the secondary fuses. In other ways transformer 110 is similar to transformer 70.

Either of transformer 110 or transformer 70 can be configured according to the transformer fusing arrangements 40, 42, 44, 46, 48, 50 as shown in FIGS. 2-7, multiples and combinations thereof, or other arrangements as dictated by a particular application; and these transformers and variations thereof can alternatively be used in electrical system 64 and controller 66 according to the present invention. Further, the present invention can be adapted to other types of transformers, winding arrangements, and fusing arrangements, and therefore may be used in other systems such as computers, automobiles, lighting ballasts, etc.

Figure 11:
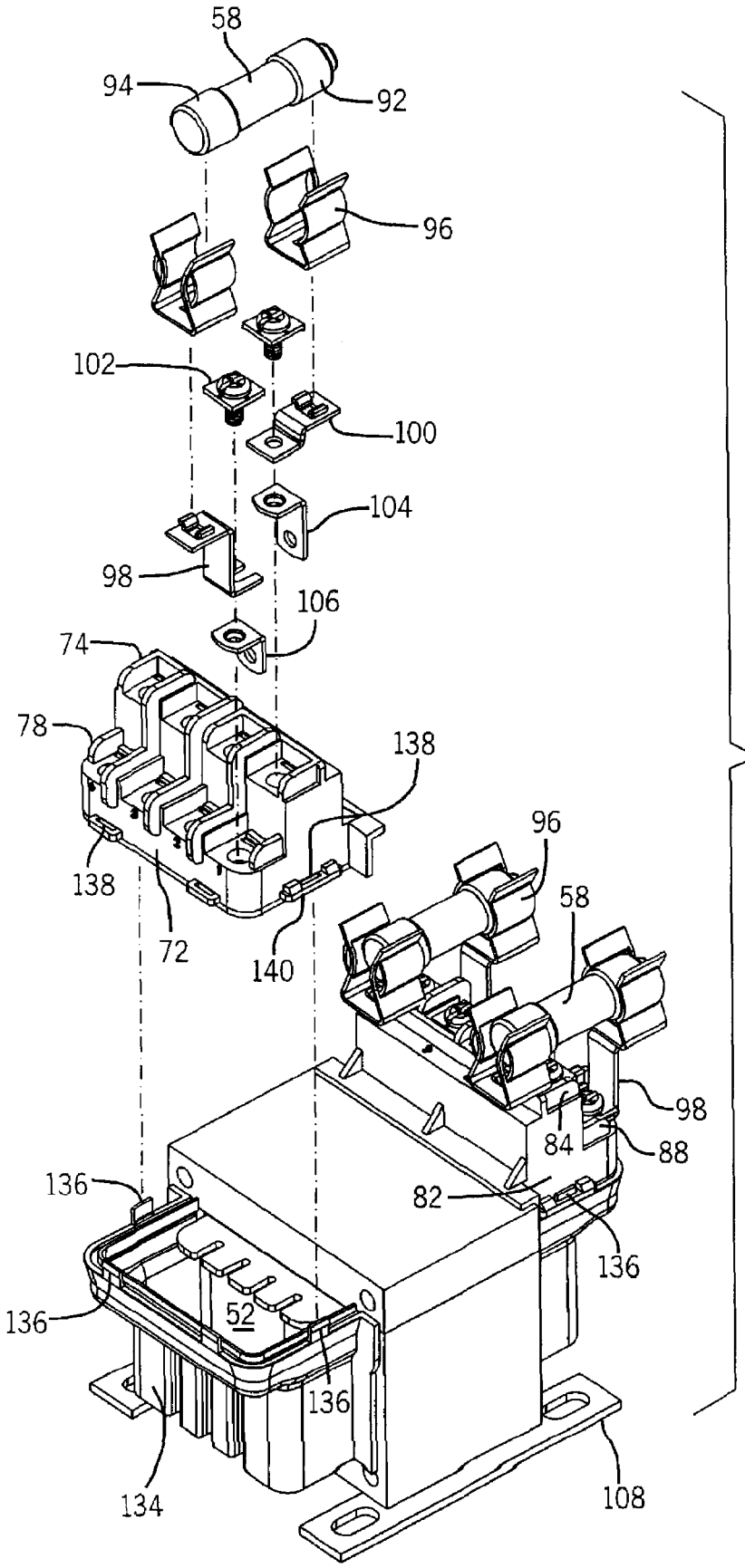
FIG. 11 is a partially exploded perspective view of the transformer of FIG. 9.
Figure 12:
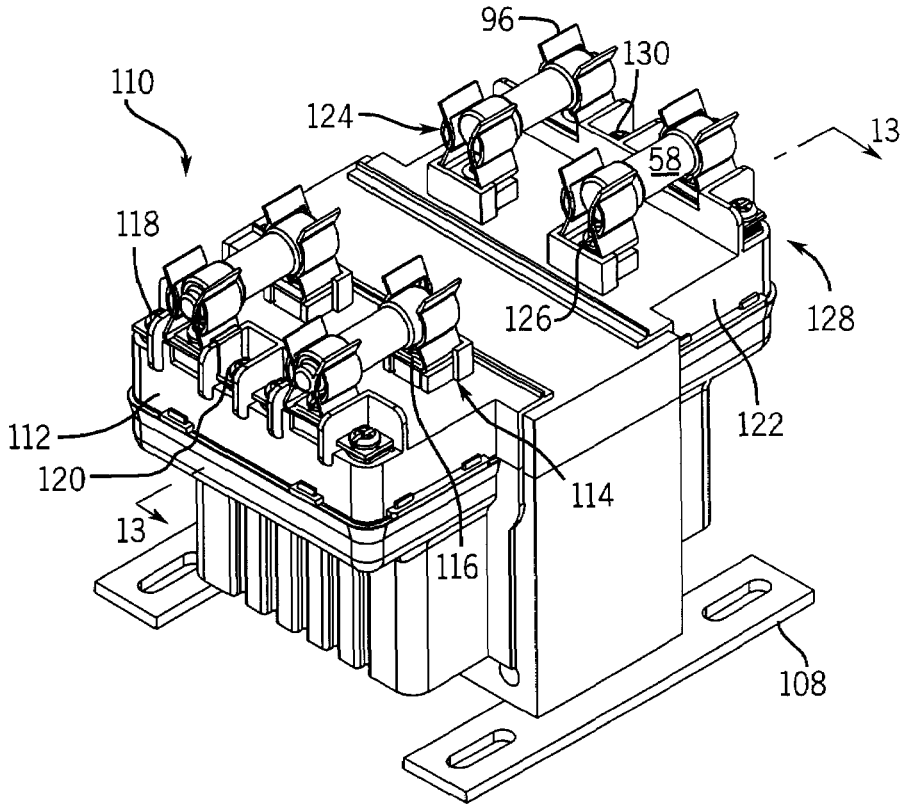
FIG. 12 is a perspective view of another embodiment of a transformer according to the present invention.
Figure 13:
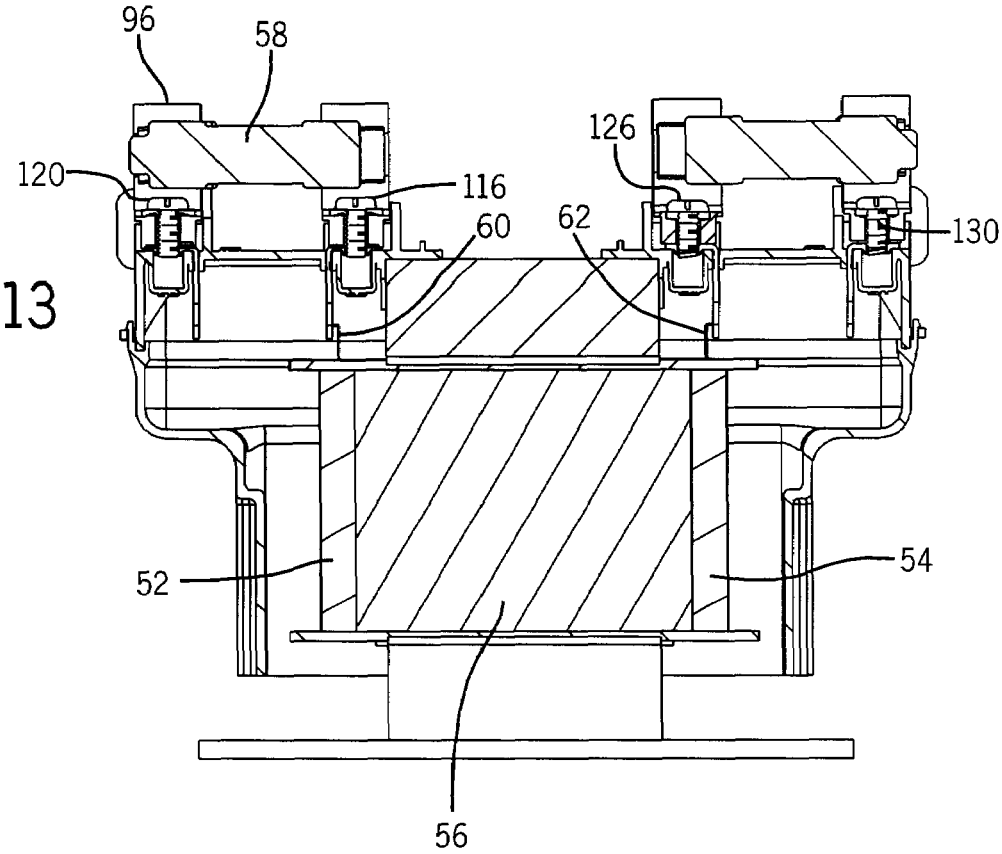
FIG. 13 is a cross-sectional view taken along section line 13-13 in FIG. 12.
Figure 14:
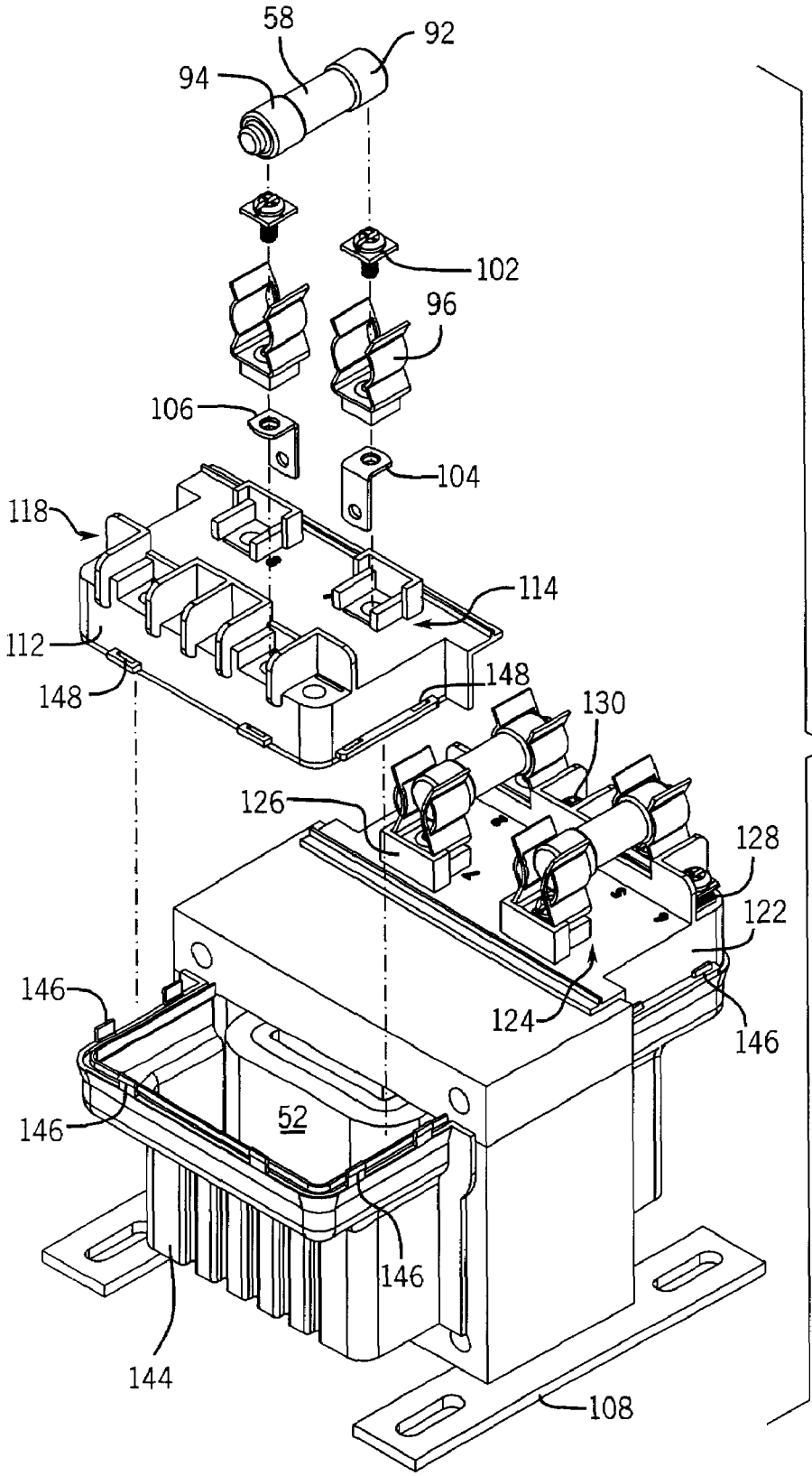
FIG. 14 is a partially exploded perspective view of the transformer of FIG. 12.
Figure 15:
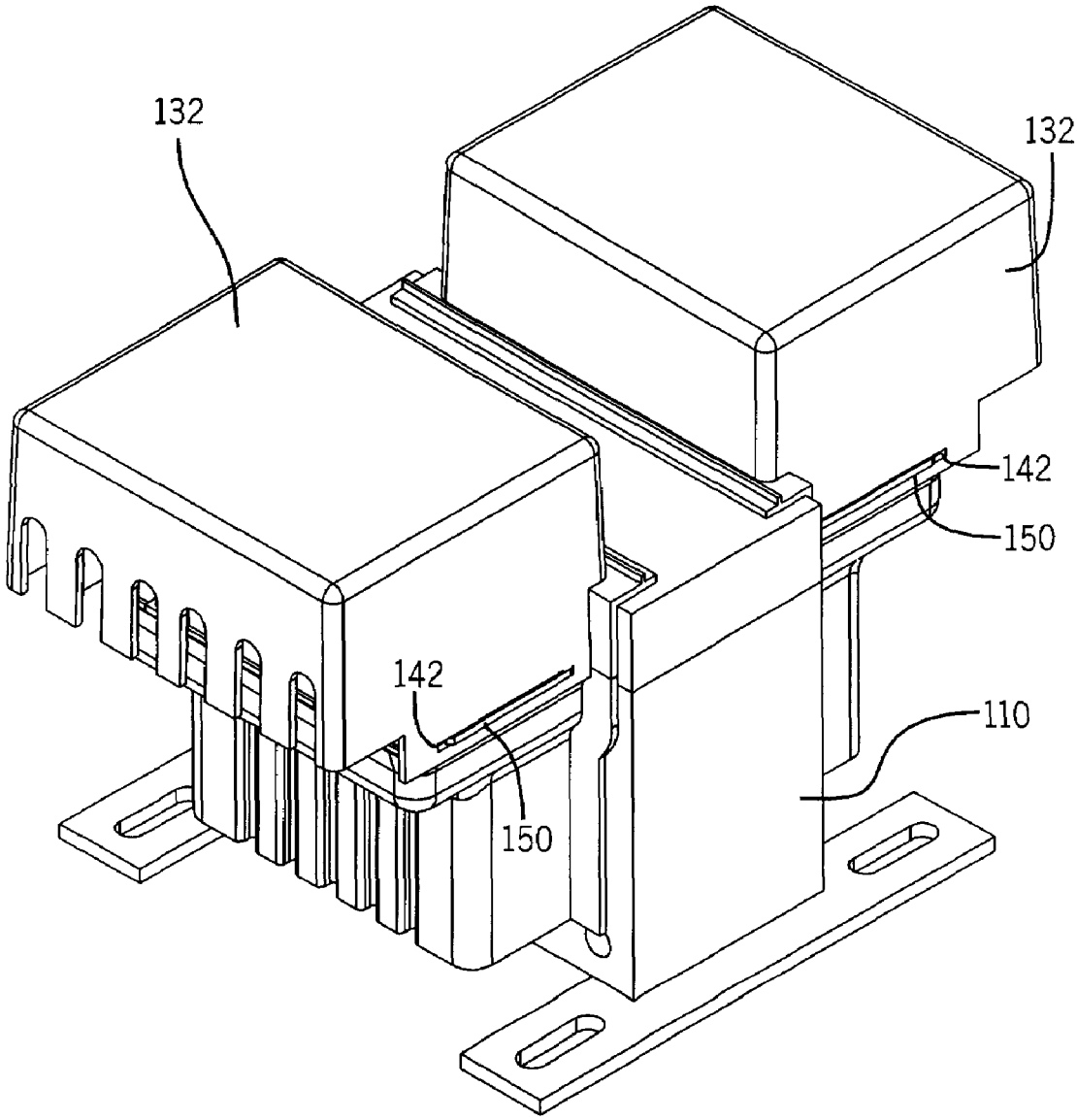
FIG. 15 is a perspective view of the transformer of FIG. 12, and illustrating a finger guard mounted on the transformer.

In other aspects of the present invention, transformers 70 and 110 can include at least one terminal block in a snap fit arrangement with the corresponding transformer housing. Referring particularly to FIGS. 11 and 15, transformer 70 can include a transformer housing 134 which holds primary winding 52, secondary winding 54 and/or core 56. The snap fit arrangement can comprise at least one ramped protrusion 136 on housing 134, and at least one corresponding terminal block aperture 138 in terminal blocks 72, 82. Further, finger guard cover 132 can be in a snap fit arrangement with a corresponding terminal block 72, 82, where this snap fit arrangement comprises at least one lateral protrusion 140 on either of the terminal blocks 72, 82, and at least one corresponding finger guard aperture 142 in the finger guard. Referring particularly to FIGS. 14 and 15, transformer 110 can include a transformer housing 144 which holds primary winding 52, secondary winding 54 and/or core 56. The snap fit arrangement can comprise at least one ramped protrusion 146 on housing 144, and at least one corresponding terminal block aperture 148 in terminal blocks 112, 122, Further, finger guard cover 132 can be in a snap fit arrangement with a corresponding terminal block 112, 122, where this snap fit arrangement comprises at least one lateral protrusion 150 on either of the terminal blocks 112, 122, and at least one corresponding finger guard aperture 142 in the finger guard.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A transformer, comprising:

a primary winding including a plurality of primary winding taps;

a secondary winding including a plurality of secondary winding taps;

a core on which said primary winding and said secondary winding are mounted, said primary winding and said secondary winding electromagnetically coupled through said core; and a terminal block connected to one of said plurality of primary winding taps and said plurality of secondary winding taps, said terminal block comprises a first row of terminals and a second row of terminals electrically isolated from the first row of terminals, at least some of the terminals in said first row are each connected to a corresponding one of said winding taps.

2. The transformer of claim 1, further including at least one additional secondary winding, where each said additional secondary winding includes an additional plurality of secondary winding taps, each said additional secondary winding mounted to said core and electromagnetically coupled with said primary winding through said core, said terminal block being connected to said additional plurality of secondary winding taps.

3. The transformer of claim 1, further including at least one fuse, each of said at least one fuse including a first fuse end and a second fuse end, said first fuse end connected to one of a terminal in said first row of terminals, said second fuse end connected to one of another terminal in said second row of electrically isolated terminals.

4. The transformer of claim 3, further including a first fuse clip connecting said first fuse end to said terminal in said first row of terminals, and a second fuse clip connecting said second fuse end to said other terminal in said second row of electrically isolated terminals.

5. The transformer of claim 1, wherein said terminal block includes said first row of terminals one of approximately parallel to and skewed to said second row of terminals.

6. The transformer of claim 1, wherein said terminal block includes said first row of terminals horizontally offset from said second row of terminals.

7. The transformer of claim 1, wherein said terminal block includes said first row of terminals vertically offset from said second row of terminals.

8. The transformer of claim 7, wherein said first row of terminals is also horizontally offset from said second row of terminals.

9. The transformer of claim 1, further including at least one finger guard at least partially covering at least one said terminal block.

10. The transformer of claim 9, wherein at least one said finger guard is in a snap fit arrangement with at least one said terminal block.

11. The transformer of claim 10, wherein said snap fit arrangement comprises at least one lateral protrusion on at least one said terminal block, and at least one corresponding finger guard aperture in at least one said finger guard.

12. The transformer of claim 1, further including a housing in which at least one of said primary winding, said secondary winding and said core is placed, said housing being in a snap fit arrangement with at least one said terminal block.

13. The transformer of claim 12, wherein said snap fit arrangement comprises at least one ramped protrusion on said housing, and at least one corresponding terminal block aperture in at least one said terminal block.

14. The transformer as recited in claim 1, wherein the terminal block is mounted to the core.

15. An electrical system, comprising:

a controller including at least one electrical load component;

a transformer connected to said electrical load component, said transformer including:

a primary winding including a plurality of primary winding taps;

a secondary winding including a plurality of secondary winding taps;

a core on which said primary winding and said secondary winding are mounted, said primary winding and said secondary winding electromagnetically coupled through said core; and at least one terminal block connected to one of said plurality of primary winding taps and said plurality of secondary winding taps, each of said at least one terminal block comprises a first row of terminals and a second row of terminals electrically isolated from the first row of terminals, at least some of the terminals in said first row are each connected to a corresponding one of said winding taps.

16. The electrical system of claim 15, further including at least one additional secondary winding, where each said additional secondary winding includes an additional plurality of secondary winding taps, each said additional secondary winding mounted to said core and electromagnetically coupled with said primary winding through said core, said at least one terminal block being connected to said additional plurality of secondary winding taps.

17. The electrical system of claim 15, wherein said controller is one of a programmable logic controller, a motor control center, and a control panel.

18. The electrical system of claim 15, wherein said electrical load component is at least one of a relay, a motor, and a contactor.

19. The transformer as recited in claim 10, wherein the at least one terminal block is mounted to the core.

20. A transformer, comprising:

a primary winding including a plurality of primary winding taps;

a secondary winding including a plurality of secondary winding taps;

a core on which said primary winding and said secondary winding are mounted, said primary winding and said secondary winding electromagnetically coupled through said core;

a first terminal block connected to said plurality of primary winding taps, said first terminal block includes a first row of terminals and a second row of terminals at least one of horizontally offset and vertically offset from said first row of terminals, at least some of said first row of terminals each connected to a corresponding one of said plurality of primary winding taps; and a second terminal block connected to said plurality of secondary winding taps, said second terminal block includes a third row of terminals and a fourth row of terminals at least one of horizontally offset and vertically offset from said third row of terminals, at least some of said third row of terminals each connected to a corresponding one of said plurality of secondary winding taps.

21. The transformer of claim 20, further including at least one additional secondary winding, where each said additional secondary winding includes an additional plurality of secondary winding taps, each said additional secondary winding mounted to said core and electromagnetically coupled with said primary winding through said core, said at least one terminal block being connected to said additional plurality of secondary winding taps.

22. The transformer of claim 20, further including at least one fuse, each of said at least one fuse connected one of between said first row of terminals and said second row of electrically isolated terminals, and between said third row of terminals and said fourth row of terminals.

23. The transformer of claim 22, further including a first fuse clip connecting a first fuse end of one fuse of said at least one fuse to a first terminal of said first row of terminals, and a second fuse clip connecting a second fuse end of said one fuse to a second terminal of said second row of electrically isolated terminals.

24. The transformer of claim 22, further including a first fuse clip connecting a first fuse end of one fuse of said at least one fuse to a first terminal of said third row of terminals, and a second fuse clip connecting a second fuse end of said one fuse to a second terminal of said fourth row of terminals.

25. The transformer of claim 20, wherein said first row of terminals are approximately parallel to said second row of terminals, and said third row of terminals are approximately parallel to said fourth row of terminals.

26. The transformer of claim 25, further including at least one fuse, each of said at least one fuse connected one of between said first row of terminals and said second row of electrically isolated terminals, and between said third row of terminals and said fourth row of terminals, each of said at least one fuse being oriented approximately perpendicular to a corresponding said row of terminals.

27. The transformer of claim 20, further including at least one finger guard at least partially covering at least one of said first terminal block and said second terminal block.

28. The transformer as recited in claim 14, wherein the at least one terminal block is mounted to the core.

29. A transformer, comprising:

a primary winding including a plurality of primary winding taps;

a secondary winding including a plurality of secondary winding taps;

a core on which said primary winding and said secondary winding are mounted, said primary winding and said secondary winding electromagnetically coupled through said core;

a housing in which at least one of said primary winding, said secondary winding and said core is placed;

a terminal block in a first snap fit arrangement with said housing; and a finger guard in a second snap fit arrangement with the terminal block, wherein the second snap fit arrangement comprises at least one lateral protrusion on the terminal block and a corresponding finger guard aperture in the finger guard.

30. The transformer of claim 29, wherein said first snap fit arrangement comprises at least one ramped protrusion on said housing, and at least one corresponding terminal block aperture in at least one said terminal block.

* * * * *